US006474638B1

(12) United States Patent
Mylaeus et al.

(10) Patent No.: US 6,474,638 B1
(45) Date of Patent: Nov. 5, 2002

(54) DEVICE FOR TURNING SHEETS

(75) Inventors: Ulrich Mylaeus, Munich (DE); Detlef Bielefeld, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 09/857,203

(22) PCT Filed: Dec. 13, 1999

(86) PCT No.: PCT/EP99/09871

§ 371 (c)(1),
(2), (4) Date: Aug. 15, 2001

(87) PCT Pub. No.: WO00/37343

PCT Pub. Date: Jun. 29, 2000

(30) Foreign Application Priority Data

Dec. 22, 1998 (DE) ..... 198 59 535

(51) Int. Cl.[7] ..... B65H 29/00

(52) U.S. Cl. ..... 271/186; 271/184; 271/303; 271/225; 271/902

(58) Field of Search ..... 271/902, 225, 271/303, 184, 185, 186

(56) References Cited

U.S. PATENT DOCUMENTS

| | | | | | |
|---|---|---|---|---|---|
| 3,273,886 | A | * | 9/1966 | Taylor | 271/225 |
| 4,159,824 | A | * | 7/1979 | Stange et al. | 271/184 |
| 4,486,012 | A | * | 12/1984 | Bock et al. | 271/186 |
| 4,512,255 | A | * | 4/1985 | Crist | 271/186 |
| 4,986,529 | A | * | 1/1991 | Agarwal et al. | 271/186 |
| 5,048,814 | A | | 9/1991 | Svyatsky | |
| 5,382,013 | A | * | 1/1995 | Walsh | 271/186 |
| 5,449,160 | A | | 9/1995 | Hou et al. | |
| 5,449,164 | A | * | 9/1995 | Quesnel et al. | 271/186 |
| 6,273,419 | B1 | * | 8/2001 | Allen et al. | 271/303 |

FOREIGN PATENT DOCUMENTS

| | | | |
|---|---|---|---|
| DE | 3605535 | 8/1987 | |
| DE | 19522131 | 1/1997 | |
| JP | 59143848 | 8/1984 | |
| JP | 59198250 | 11/1984 | |
| JP | 60-232364 | * 11/1985 | 271/225 |

OTHER PUBLICATIONS

"Belt–Driven Sheet Inverter", J. Emmelot, Xerox Disclosure Journal, XP–002136062, vol. 10, No. 5, Sep./Oct. 1985.

* cited by examiner

*Primary Examiner*—H. Grant Skaggs
(74) *Attorney, Agent, or Firm*—Bacon & Thomas, PLLC

(57) ABSTRACT

The invention relates to a device for turning sheets. A sheet to be turned is guided into a gap between two transport elements moving in opposite directions and is pressed against the reverse-moving transport element or the forward-moving transport element depending on whether or not said sheet should be turned. The following transport elements then guide the turned or unturned sheet to the output of the device. The device preferably is configured such that the same transport time is required for turned and unturned sheets so that the order of the sheets and the interval between the sheets upstream and downstream of the turning device remain the same.

14 Claims, 2 Drawing Sheets

DEVICE FOR TURNING SHEETS

BACKGROUND OF THE INVENTION

The invention relates to a device for turning sheets. Such devices are known, for example, in connection with letter sorting equipment. In this regard, the turning device serves to manipulate letters inserted in an arbitrary orientation, such that a side of preference in the transport system or in the pigeonholes at all times comes to lie on one specific side, such that the address of letters is visible and legible. The function of turning is discussed as follows. The letters to be turned are fed to a short, dead-end-like section of the transport system, are stopped there and accelerated again in reverse direction, thereby leaving the transport system in inverted manner. Due to the fact that the intervals between the letters in the transport system of the letter sorting apparatus are narrow and decelerating as well as accelerating take a long time, two turning devices must be arranged in parallel in the letter sorting apparatus in order to be able to continuously process the stream of letters. Moreover, the drive systems for decelerating and accelerating are relatively complex due to the masses of the transport elements involved. However, devices for turning sheets are known as well in connection with banknote sorting machines. For example, the banknotes to be turned can be clamped between two elastic flat belts guided across rollers in a manner arranged on top of each other and twisted by 180°. Such a device is shown also in EP 0 532 217 A1 for example. Although such a device permits continuous processing of the banknotes, the known device nevertheless entails the disadvantage that the banknotes, due to the twisting of the belts, are subject to mechanical loads during turning, whereby the banknotes may be damaged. Due to the system, there is moreover the disadvantage that only sheets arriving symmetrically can be passed on to the subsequent transport system in uniform manner. However, this constitutes considerably restricting marginal conditions in sorting banknotes, e.g. in singularizing, scanning and stacking.

U.S. Pat. No. 5,048,814 reveals a device for turning documents, which turns all of the documents fed to the device. To this end, there is provided a lever that is biased by the documents entering the device and presses the documents, after the same have fully entered the device, onto a belt running in the opposite direction. The documents then are transported out of the device in the opposite direction and thus are turned.

SUMMARY OF THE INVENTION

It is the object of the invention to suggest a device for turning sheets which, with low technical expenditure, renders possible continuous processing of the sheets, however, without subjecting the sheets to mechanical loads during turning.

This object is met by the features indicated in the main claim.

According to the invention, the sheets to be turned are fed into a gap between two transport elements continuously driven in opposite directions, with the particular sheet being pressed against the forward-moving or reverse-moving transport element by means of guiding elements actuated by an actuator. Preferably, the transport elements are in the form of elastic flat belts and the guiding elements are in the form of guide plates which, either with or without pressing rollers, press the sheet toward the one or other belt. Due to the low mass of the guide plates, e.g. a simple lifting magnet may be used as actuator, moving the guide plates in linear manner. Due to this, the switching times may be kept so short that, observing the minimum distance between two sheets, these can be processed in continuous manner. Additional advantages and further developments of the invention are set forth in the dependent claims as well as in the embodiments of the specification with reference to the drawings wherein

DETAILED DESCRIPTION OF THE INVENTION

Figure 1:
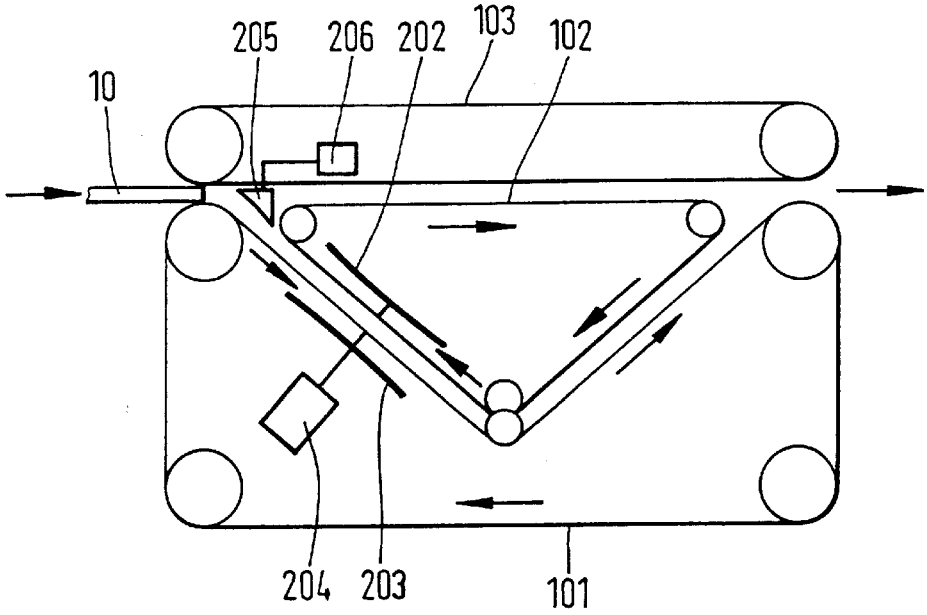
FIG. 1 shows a side view of a first preferred embodiment.

FIG. 1 shows a first preferred embodiment of the invention in a schematic diagram. The sheet 10 transported in the direction of the arrow is guided, by means of a switch means 205, into a gap formed by two transport belts 101, 102 moving in opposite directions; in the region of said gap, there are arranged the guiding elements, e.g. in the form of guide plates 202 and 203. For turning the sheet present between guide plates 202 and 203, an actuator 204, such as a lifting magnet configured to press the sheet via guide plate 202 against transport belt 102 moving in reverse direction with respect to the direction of transport of the sheet. The sheet thus is moved in reverse direction and is guided by switch means 205 between transport belts 102 and 103. To this end, the switch means 205 is controlled correspondingly e.g. via an actuator 206. The guide plates 202, 203 may have pressing rollers, not shown here, for guiding and accelerating the sheet. In the event that the particular sheet is not to be turned, the actuator 204 urges the sheet by way of guide plate 203 against the transport belt 101 moving in the direction of transport of the sheet. In that event, the sheet moves along a V-shaped path formed by the transport belts 101, 102. In the present embodiment, part of the turning length is utilized as well for the transport path of the unturned sheet, thereby reducing the expenditure for this second transport path. This V-shaped transport path is used as well to simulate the loss in time caused by turning of the sheet. It is thus possible that both turned and unturned sheets have equal transport times in the turning device. The sheets thus may be introduced almost at the same intervals into an additional transport system, not shown here, of a sorting device.

FIG. 1 shows a first preferred embodiment of the invention in a schematic diagram. The sheet 10 transported in the direction of the arrow is guided, by means of a switch means 205, into a gap formed by two transport belts 101, 102 moving in opposite directions; in the region of said gap, there are arranged the guiding elements, e.g. in the form of guide plates 202 and 203. For turning the sheet present between guide plates 202 and 203, an actuator 204, e.g. a lifting magnet, presses the sheet via guide plate 202 against transport belt 102 moving in reverse direction with respect to the direction of transport of the sheet. The sheet thus is moved in reverse direction and is guided by switch means 205 between transport belts 102 and 103. To this end, the switch means 205 is controlled correspondingly e.g. via an actuator 206. The guide plates 202, 203 may have pressing rollers, not shown here, for guiding and accelerating the sheet. In the event that the particular sheet is not to be turned, the actuator 204 urges the sheet by way of guide plate 203 against the transport belt 101 moving in the direction of transport of the sheet. In that event, the sheet moves along a V-shaped path formed by the transport belts 101, 102. In the present embodiment, part of the turning length is utilized as well for the transport path of the unturned sheet, thereby reducing the expenditure for this second transport path. This V-shaped transport path is used as well to simulate the loss in time caused by turning of the sheet. It is thus possible that both turned and unturned sheets have equal transport times in the turning device. The sheets thus may be introduced almost at the same intervals into an additional transport system, not shown here, of a sorting device.

Figure 2:
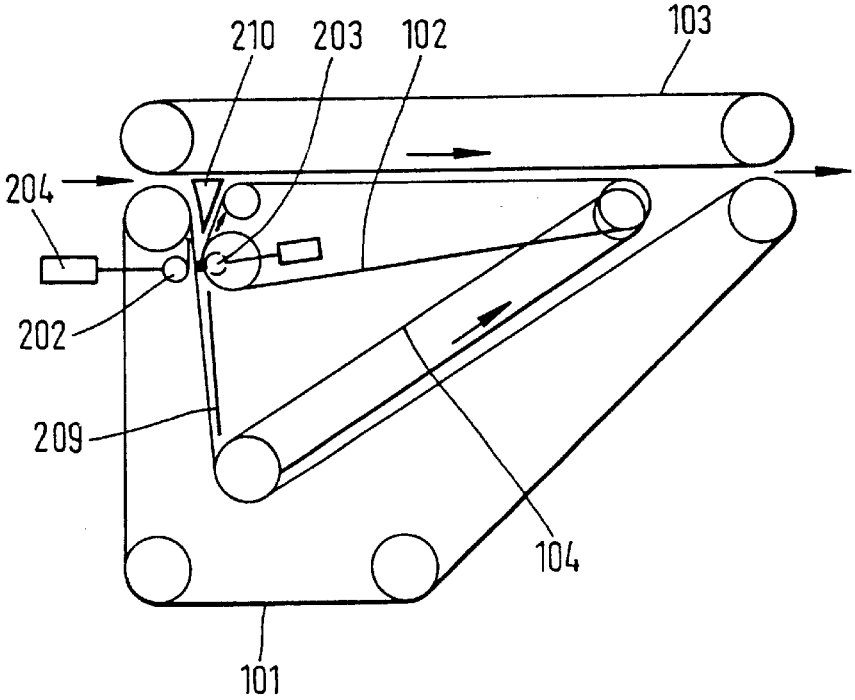
FIG. 2 shows a side view of a second embodiment.

FIG. 2 shows a schematic diagram of a second embodiment. The functional principle is the same as with the first embodiment; the essential difference resides in the design of the guiding elements. The guiding elements 209 and 210 are rigidly mounted, whereas the relatively small guiding elements 202 and 203 are movable. The guiding elements 202 and 203 may be operated e.g. by one or two actuators 204. The sheet not shown here is transported in the direction of the arrow and is passed by rigid guiding element 210 in downward direction into the vertical transport path. If the sheet is to be turned, the guiding elements 202 and 203 are shifted towards the right as soon as the rear edge of the sheet is in the region of said guiding elements 202 and 203, thereby eliminating firstly the contact between guiding element 203, downward-moving transport element 101 and the sheet arranged therebetween, and establishing secondly contact between guiding element 202, upward-moving transport element 102 and the sheet arranged therebetween. The sheet thus is accelerated in reverse direction and, due to the horizontal displacement of guiding elements 202 and 203, is introduced at the right-hand edge of the rigid guiding element 210 into the transport path formed by transport elements 102 and 103 and leaves the device on this transport path. The guiding elements 202 and 203 preferably contain rollers to safely guide and accelerate the sheets. If a sheet is not to be turned, the guiding element 203 presses the sheet against transport element 101 and conveys the same downwardly and then towards the upper right out of the device. It is advantageous in this embodiment that the moving masses of the guiding elements and thus the switching times can be further reduced in comparison with the first embodiment. Moreover, the region between the transport elements 101 and 102 running in opposite directions, which is subject to the risk of transport disturbances, has been reduced to a minimum. The uncontrolled condition of movement of the sheet during the switching operation has been reduced considerably thereby, whereby the occurrence of transport disturbances in this region can be avoided.

Figure 3:
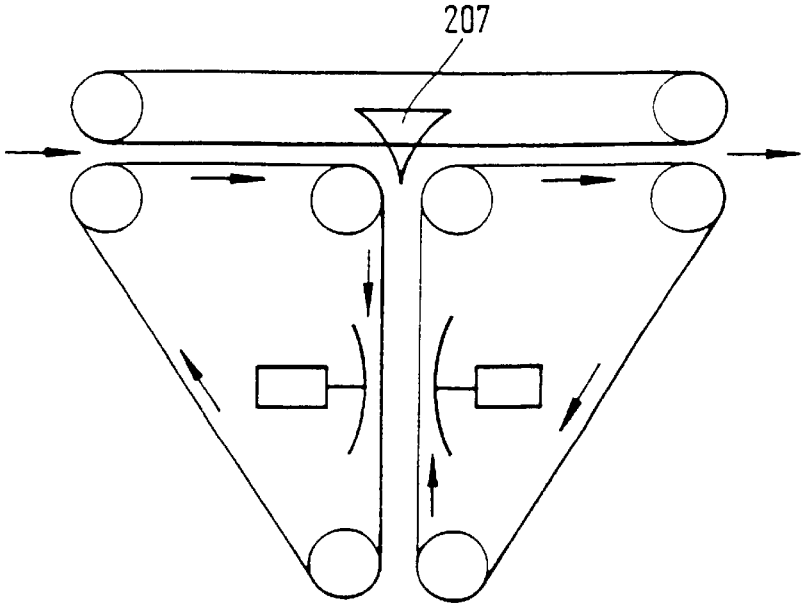
FIG. 3 shows a side view of a third embodiment.

FIG. 3 shows the schematic diagram of a third embodiment. The functional principle is the same as with the first embodiment; the essential difference resides in the arrangement and control of switch means 207. In the event a sheet is not to be turned, the switch means 207 is actuated such that the sheet conveyed in the direction of the arrow is allowed to directly pass through the turning device. This embodiment permits a simple transport path for the unturned sheet that is not susceptible of disturbance. However, uniform transport intervals of turned and unturned sheets are no longer possible.

Figure 4:
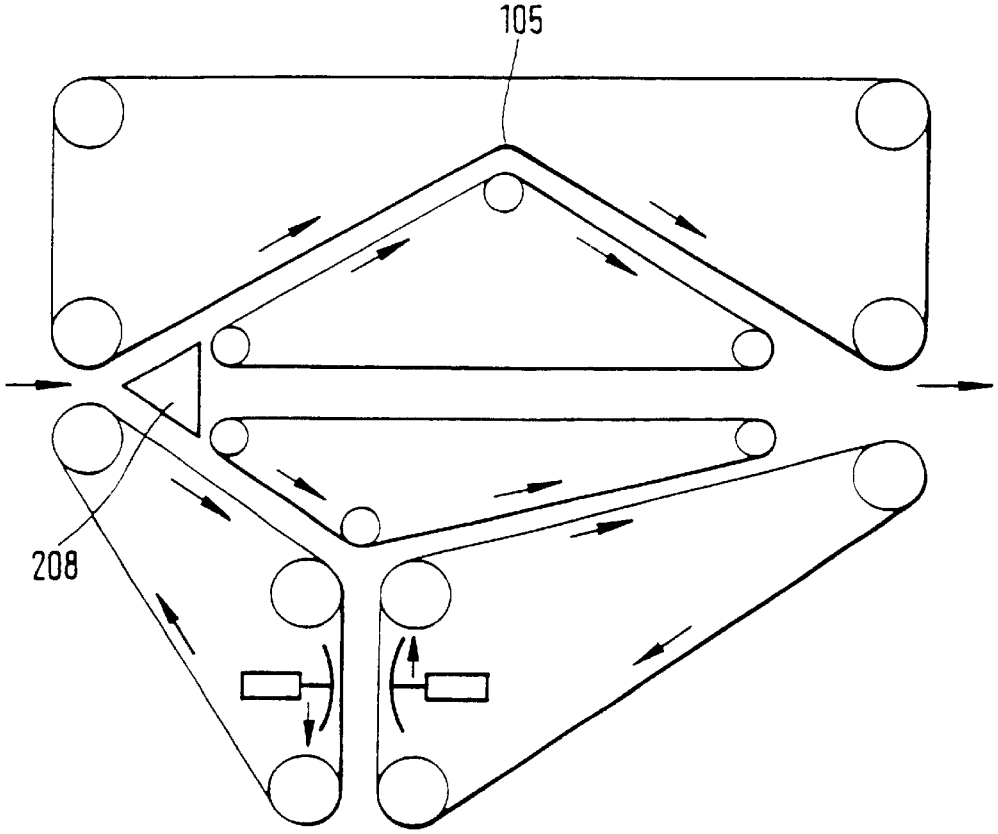
FIG. 4 shows a side view of a fourth embodiment.

FIG. 4 shows the schematic diagram of a fourth embodiment. The difference from the first and fourth embodiments resides in the path of the unturned sheet which is fed into a separate, parallel transport path by a switch means 208. The transport path 105 may be matched in length in such a manner that uniform transport intervals of turned and unturned sheets are possible.

What is claimed is:

1. A device for selectively reversing the orientation of sheet material comprising:

forward transport elements configured to transport the sheet material along a forward transport path; and reverse transport elements configured to transport the sheet material along a reverse transport path, said forward and reverse transport elements defining a clearance therebetween whereat the sheet material enters traveling along the forward transport path;

wherein said forward and reverse transport paths individually direct the sheet material to a single one output of said device;

wherein the transport path of the sheet material is selectively reversed by a first guiding element positioned along said clearance and configured to move transversely across said clearance by an actuator arranged to urge the sheet material against said reverse transport elements so that the sheet material is transported along said reverse transport path to said output, non-reversed sheet material continuing along said forward transport path to said output.

2. The device according to claim 1, wherein the forward and reverse transport elements include elastic belts.

3. The device according to claim 1, wherein the sheet material is maintained along said forward transport path by a second guiding element moved by an actuator to press the sheet material against said forward transport elements so as to be transported along said forward transport path to said output.

4. The device according to claim 3, wherein the first and second guiding elements are actuated by at least one actuator.

5. The device according to claim 3, wherein the sheet material is subjected to horizontal displacement by the first or second guiding elements when said first or second guiding elements are urged against the sheet material transported by said device.

6. The device according to claim 3, wherein the sheet material is introduced between said first and second guiding elements by a switch device.

7. The device according to claim 6, wherein the switch device is actuated by an actuator.

8. The device according to claim 6, wherein the switch device is spring-loaded.

9. The device according to claim 3, wherein said first and second guiding elements are oppositely opposed along the forward and reverse transport elements, respectively.

10. The device according to claim 1, wherein reversed sheet material is directed along said reverse transport path to an additional transport element by a switch device.

11. The device according to claim 10, wherein the switch device is actuated by an actuator.

12. The device according to claim 10, wherein the switch device is spring-loaded.

13. The device according to claim 1, wherein the device is configured such that the duration of travel time for the sheet material traveling along the forward and reverse transport paths to reach said output is substantially identical.

14. The device according to claim 1, wherein the device is configured such that the duration of travel time for the sheet material traveling along the forward and reverse transport paths to reach said output is different such that only the time duration of transport for each sheet material traveling from an entry point of said device to said clearance is identical.

* * * * *